US005782475A

United States Patent [19]

Balmain

[11] Patent Number: 5,782,475

[45] Date of Patent: Jul. 21, 1998

[54] SNOWBOARD BINDING ASSEMBLY

[75] Inventor: Patrick Balmain, 3, rue du Lieutanant-Barret, Fourneaux, France, 73500

[73] Assignee: Patrick Balmain, Fourneaux, France

[21] Appl. No.: 331,517

[22] PCT Filed: Apr. 27, 1993

[86] PCT No.: PCT/FR93/00417

§ 371 Date: Jan. 10, 1995

§ 102(e) Date: Jan. 10, 1995

[87] PCT Pub. No.: WO93/22013

PCT Pub. Date: Nov. 11, 1993

[30] Foreign Application Priority Data

Apr. 27, 1992 [FR] France ..... 92 05264
Oct. 29, 1992 [FR] France ..... 92 12970

[51] Int. Cl.[6] ..... A63C 5/03; A63C 5/04; A63C 9/00

[52] U.S. Cl. ..... 280/14.2; 280/607; 280/609; 280/618

[58] Field of Search ..... 280/14.2, 607, 280/609, 617, 618, 633, 601; 441/65, 68, 70

[56] References Cited

U.S. PATENT DOCUMENTS

| | | | |
|---|---|---|---|
| 3,900,204 | 8/1975 | Weber . | |
| 3,947,049 | 3/1976 | Pederson . | |
| 4,995,631 | 2/1991 | Hunter | 280/607 |
| 5,018,760 | 5/1991 | Remondet | 280/14.2 |
| 5,058,910 | 10/1991 | Teeter et al. | 280/14.2 |
| 5,277,635 | 1/1994 | Gillis | 441/70 |

FOREIGN PATENT DOCUMENTS

| | | | |
|---|---|---|---|
| 2600548 | 12/1987 | France . | |
| 2604631 | 4/1988 | France . | |
| 2659246 | 9/1991 | France . | |
| 2659563 | 9/1991 | France | 280/14.2 |
| 2557275 | 7/1977 | Germany . | |
| 8802415 | 5/1988 | Germany . | |
| 3910468 | 11/1989 | Germany | 280/14.2 |
| 9001792 | 6/1990 | Germany . | |
| 3903401 | 8/1990 | Germany . | |
| 9102236 | 5/1991 | Germany . | |
| 8002232 | 10/1980 | WIPO | 280/14.2 |

*Primary Examiner*—Anne Marie Boehler
*Attorney, Agent, or Firm*—Weiser & Associates, P.C.

[57] ABSTRACT

An apparatus for gliding on snow with improved stability and better edge-setting in turns includes a single board having a raised tip at the front and a heel at the rear, and a safety binding assembly for securely joining boots to the board. The safety binding assembly includes first and second bindings positioned on the board to prevent movement and rotation in translation, and to form an angle between 0 and 20 degrees relative to the longitudinal axis of the board. The bindings are longitudinally displaced so that the longitudinal distance between them is at most equal to 100 millimeters. The sides of the board include center portions which are concave in shape between the tip and heel of the board, and rectilinear portions located where the center portions of the sides intersect with the tip and heel of the board.

36 Claims, 5 Drawing Sheets

FIG. 2A
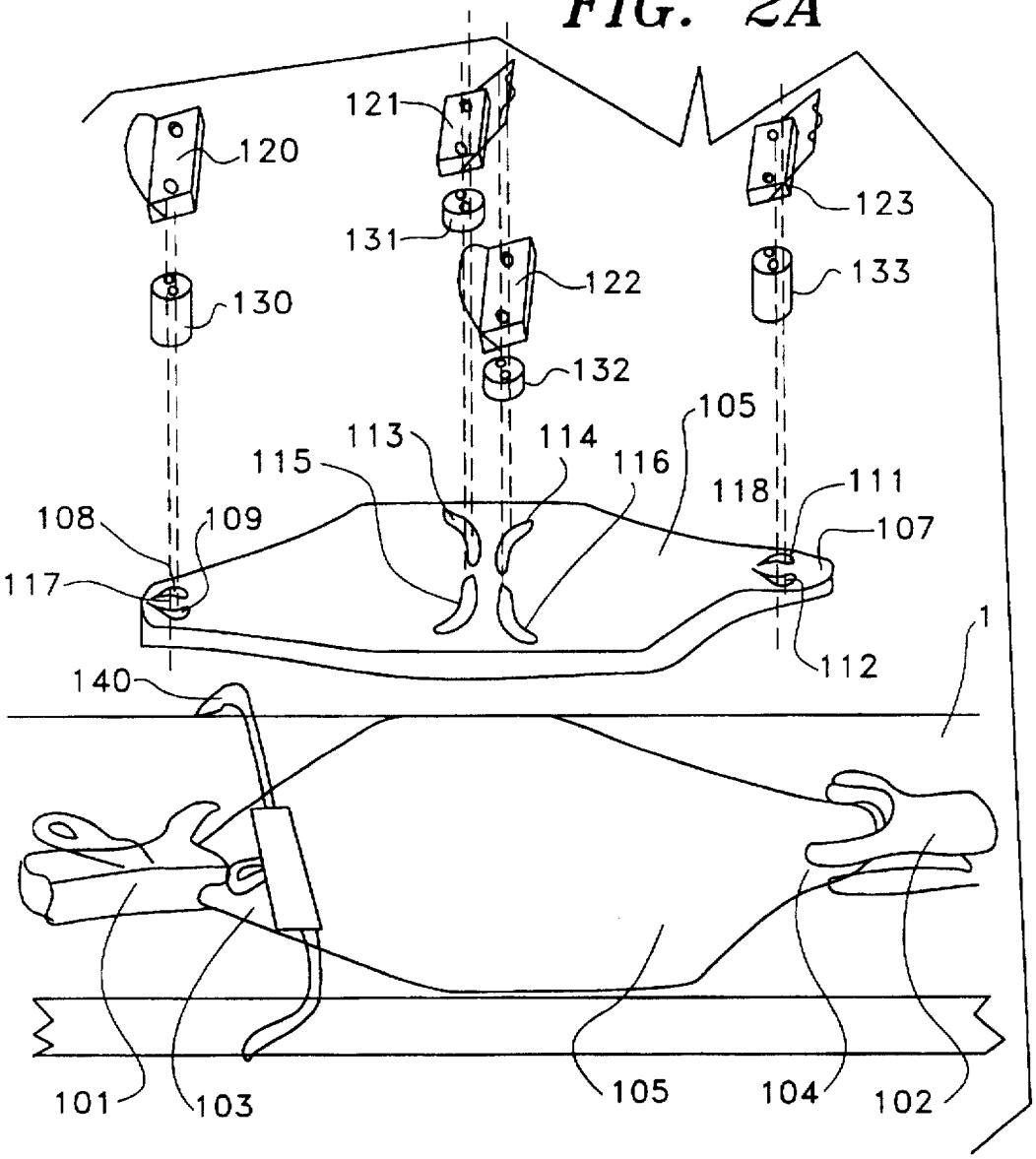
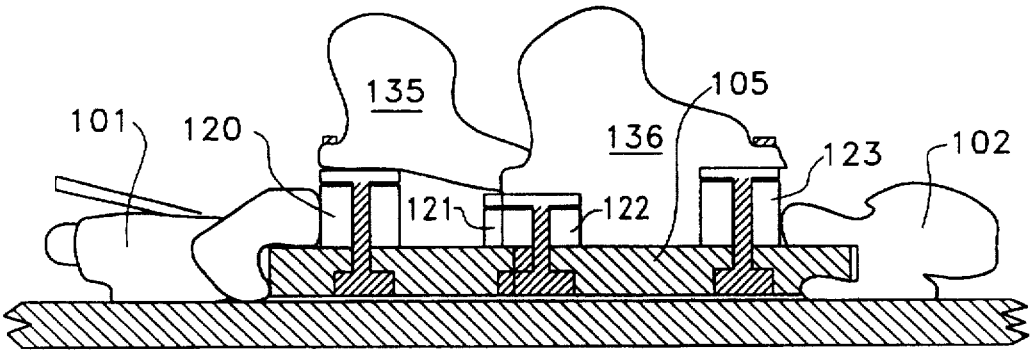
FIG. 2B

SNOWBOARD BINDING ASSEMBLY

BACKGROUND OF THE INVENTION

The present invention relates to a piece of sporting equipment for gliding on snow of the type constituted by a single board with a raised tip, on which two bindings for solidly joining boots with the board can be mounted.

Two types of gliding equipment for snow using a single board are known. This would include monoskis, as disclosed for example in French Patent 2,604,631 or U.S. Pat. No. 3,947,049, in which the two bindings are parallel and disposed on the same transverse line, or snowboards, as disclosed for example in French Patent 2,600,548, in which a front binding is oriented longitudinally and a rear binding is oriented transversely, so that the user is placed in a semi-lateral position.

Two hybrid gliding devices have also been proposed. For example, German Patent 25 57 275 discloses a monoski constituted by a board on which the bindings are longitudinally offset, one behind the other. In order to compensate for the described device's lack of maneuverability, the board has a convex profile and the skier uses a small guide rope attached to the front of the board, which allows the skier to provide the impetus for entering a turn. German Patent 39 03 401 discloses another such gliding device.

SUMMARY OF THE INVENTION

It is the primary object of the present invention to provide a piece of gliding equipment which is constituted by a single board, and which is capable of causing sensations that are different from those produced with prior equipment.

It is also an object of the present invention to provide a piece of gliding equipment which is constituted by a single board, and which is capable of being used on powdery snow as well as on packed trails.

It is also an object of the present invention to provide a snowboard which provides the user with a better view of the slope, particularly during the end phase of a turn, when the user is supported on his toes and has their back to the slope.

These and other objects which will be apparent are achieved in accordance with the present invention by providing an apparatus for gliding on snow which is comprised of a single board, a first binding which is positioned on the board in a way that is not movable in rotation or in translation, and so that the longitudinal axis of the first binding forms an angle between 0 degrees and 20 degrees, and preferably between 4 and 16 degrees, with the median longitudinal axis of the board, and a second binding which is positioned on the board in a way that is not movable in rotation or in translation, and so that the longitudinal axis of the second binding forms an angle between 0 degrees and 20 degrees, and preferably between 4 and 16 degrees, with the median longitudinal axis of the board, wherein the bindings are longitudinally displaced so that the longitudinal distance between the front end of the rear boot and the rear end of the front boot is at most equal to 100 millimeters. As a result, the user's head and shoulders are naturally positioned over the tip of the board, and the user's feet are positioned substantially one behind the other.

Preferably, the median axes of the two bindings are parallel, and the bindings are positioned symmetrically relative to an oblique axis which forms an angle between 4 and 16 degrees with the longitudinal axis of the board.

In a preferred embodiment, the width of the board at the center is substantially equal to 1.5 times the width of one boot. The width of the board at its center is advantageously between 110 millimeters and 150 millimeters, and is preferably on the order of 140 millimeters.

Such a gliding device offers improved ease of use and greater maneuverability.

In a first variant, the middle point of each of the bindings is positioned on the median longitudinal axis of the board. Further, the bindings are in parallel and positioned one behind the other so that the toe of the front binding reaches one of the lateral sides of the board, and the heel of the rear binding reaches the opposite lateral side of the board. The median axes of the two bindings are in parallel and form an angle of approximately 7° with the median longitudinal axis of the board.

In a second variant, the toe of the front binding and the heel of the rear binding are positioned on the median longitudinal axis of the board, and the toe of the rear binding and the heel of the front binding are positioned on opposite lateral sides of the board. The toes and heels of the user's two feet form a supportive polygon that is diamond-shaped relative to the median longitudinal axis of the board, which ensures satisfactory balance on the gliding apparatus.

Preferably, the board includes a rounded tip, a central portion having lateral edges defined (on either side) by the arcs of a circle or an ellipse, and a heel with a straight lateral segment on each side of the board, providing the board with a "wasp waist" or central hollow. What is meant by "hollow" is the distance measured along an axis perpendicular to the median longitudinal axis of the board, between a line connecting the widest forward portion and the widest rear portion of the board, and the edge of the board at its narrowest point. Preferably, the central hollow of the board is between 1 and 3 centimeters.

In an advantageous embodiment, a straight side edge is formed between the central hollow (in the form of an arc of a circle or an ellipse) and the beginning of the tip of the board. This straight segment produces a progressive attack during edging, and avoids overly sensitive reactions of the board that might tend to cause the user to lose balance. The size of the user's support area (triangle) is reduced as a consequence of the configuration of the assembly of the present invention. The length of the straight side edge between the beginning of the tip and the curved central hollow is advantageously between 2 and 25 centimeters. It is also advantageous to provide the board with a straight side edge extending between the central hollow and the beginning of the heel.

In a preferred embodiment, the front binding is positioned so that the middle of the tip of the boot is situated on the median longitudinal axis of the board, and the rear binding is positioned so that the middle of the heel of the boot is situated on the median longitudinal axis of the board.

In a variant, the assembly of the present invention includes a linkage plate which includes two bindings for boots, and the board includes two longitudinal safety bindings for solidly joining the linkage plate to the board.

In a preferred variant, the linkage plate has a diamond shape, and has front and rear ends suitable for cooperating with known safety bindings. Further, the linkage plate includes a rear shim (preferably with a thickness between 5 and 30 millimeters) attached to the linkage plate in an angularly adjustable manner, a front shim (preferably with a thickness between 5 and 30 millimeters) attached to the linkage plate in an angularly adjustable manner, and two central shims (preferably with a thickness between 0 and 20 millimeters) attached to the linkage plate in a laterally adjustable manner. The bindings for the boots are solidly joined with the shims.

The invention will be better understood with reference to the following description, together with the following drawings corresponding to non-limiting examples of illustrative embodiments.

BRIEF DESCRIPTION OF THE DRAWINGS

FIG. 2A is an exploded isometric view of the boot bindings of the assembly of FIG. 1.

FIG. 2B is a partially sectioned, side elevational view of the assembly of FIG. 2A.

DETAILED DESCRIPTION OF PREFERRED EMBODIMENTS

Figure 1:
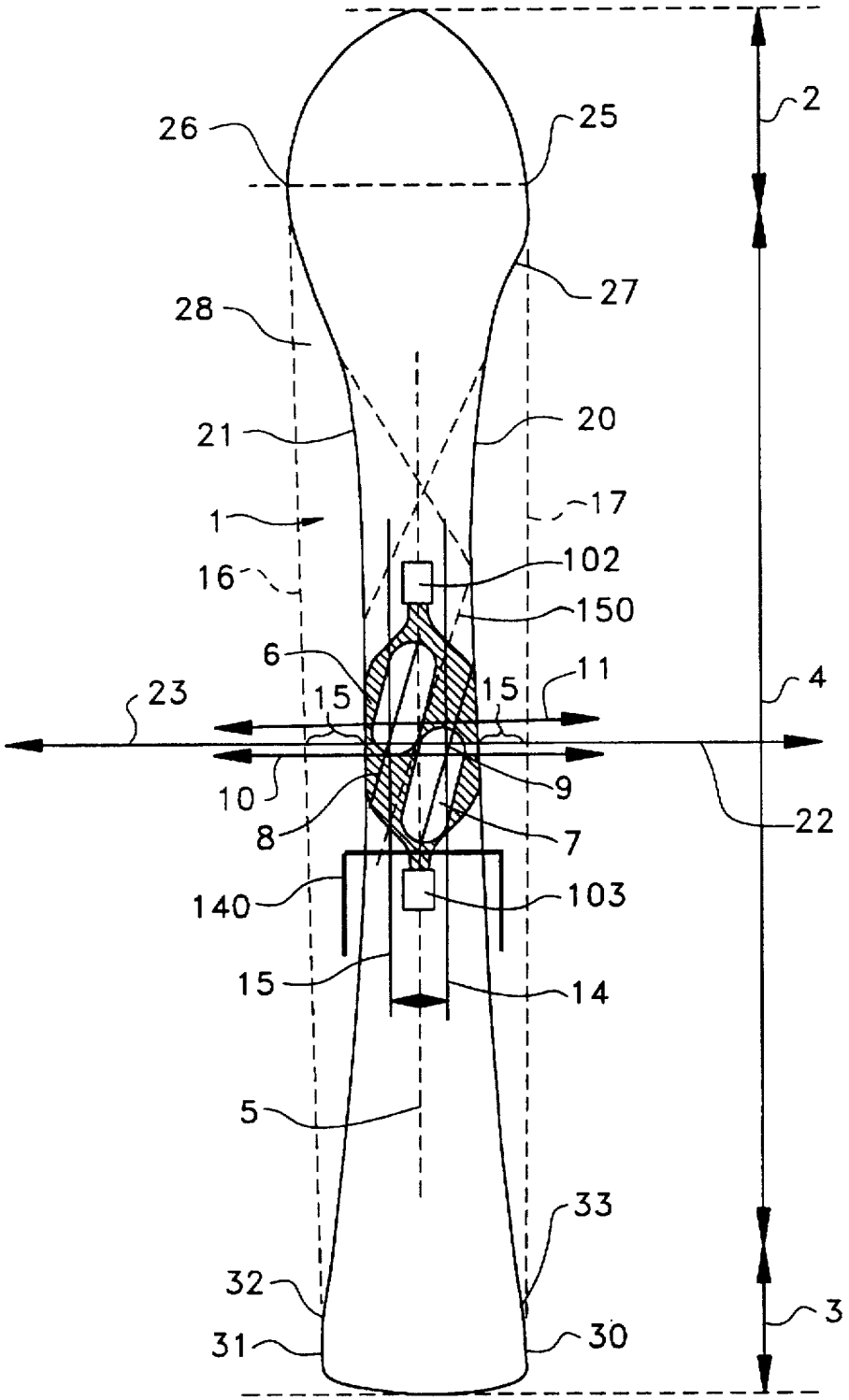
FIG. 1 is a top plan view of an embodiment of a gliding assembly according to the present invention.

FIG. 1 shows a first embodiment of the gliding assembly of the present invention. The disclosed embodiment includes a board 1 which has a tip 2 at its front and a heel 3 at its rear. The total length of the board will vary as a function of the size and weight of the user (e.g., 178 centimeters). The width of the board 1, measured at the middle of the board, is preferably between 105 and 150 millimeters (140 millimeters in the present example).

The central portion 4 of the board 1 has a median longitudinal axis 5. Laterally, the board 1 is defined by edges 20, 21 constituted by curved arcs extending along the major portion of the board's length (i.e., along the central portion). Central hollows 15 are defined between the edges 20, 21 and axes 16, 17 connecting the widest portions of the board 1, at the tip 2 and the heel 3. At the middle of the board 1, the central hollows 15 are between 10 and 30 millimeters, and preferably on the order of 25 millimeters. The maximum width of the board 1 is on the order of 230 millimeters at the widest part of the tip 2 and on the order of 220 millimeters at the widest part of the heel 3.

The edges 20, 21 are arc-shaped, and constitute a portion of a circle or an ellipse. The center of the circle forming a circular arc, or the center of the two foci forming an elliptical arc, is placed on an axis 22, 23 perpendicular to the median longitudinal axis 5 of the board 1. In the case in which the board is symmetrical, the axis 22, 23 runs between the rear of the front binding and the front of the rear binding. In the case in which the board is asymmetrical, the centers of the left and right arcs of a circle, or the midpoints of the two foci defining the left and right elliptical arcs, are offset longitudinally, and are respectively situated slightly behind and slightly in front of the axis 22, 23 which runs through the middle of the board 1 (and the centers of the two bindings, with the left binding being the forwardmost binding in the example described).

Between the beginning (the axis 25, 26) of the tip 2 and the beginning of the curved side edges 20, 21, the board 1 has a segment with substantially rectilinear edges 27, 28 which facilitate edge setting and improve stability at the start of a turn. The two rectilinear segments 27, 28 are of identical length, and their angle β relative to the median longitudinal axis 5 of the board 1 is determined by the tangent at the resulting transition point.

Straight segments 30, 31 may similarly be provided between the ends of the curved side edges 20, 21 and the beginning (the axis 32, 33) of the heel 3. Preferably, the length of the straight segments 30, 31 is substantially equal to the length of the straight segments 27, 28, and is on the order of 10 centimeters, with lengths between 2 centimeters and 25 centimeters being particularly advantageous.

The central part of the board 1 allows a linkage plate 100 for the binding of ski or snowboarding boots to be solidly joined to the board 1. This linkage plate 100 includes two bindings 6, 7, which are described in more detail with reference to FIGS. 2A and 2B. The longitudinal axis 8 of the front binding 6 forms an adjustable angle of between 1 degree and 16 degrees with the longitudinal axis 5 of the board 1. The longitudinal axis 9 of the rear binding 7 also forms an adjustable angle of between 1 degree and 16 degrees with the longitudinal axis 5 of the board 1. The longitudinal axes 8, 9 of the two respective bindings 6, 7 are preferably parallel.

A perpendicular 10 to the longitudinal axis 5 of the board 1 which runs through the rear of the forwardmost binding 6 is behind, or at most coincides with, a perpendicular 11 to the longitudinal axis 5 of the board 1 which runs through the front of the rearmost binding 7. The distance between the two perpendiculars 10, 11 is between 0 and 100 millimeters, and is preferably on the order of 50 millimeters.

The board 1 includes two safety bindings 101, 102, of a known type, disposed on the median longitudinal axis 5 of the board. The bindings 101, 102 are fastened (e.g., by screws) in a longitudinal direction, and are separated by a distance substantially corresponding to the length of the linkage plate 100 (which approximately corresponds to the length of two ski boots; on the order of 500 millimeters).

The linkage plate 100 is constituted by a plate which, taken as a whole, has a diamond shape. The length of the linkage plate 100, measured on the median longitudinal axis 5, is on the order of 500 millimeters, and the width of the linkage plate 100, measured on the median transverse axis, is slightly less than the width of the board 1. The rear end 103 of the linkage plate 100 is cut away in order to produce a rounded zone which extends approximately 30 degrees from both sides of the median longitudinal axis 5 (with a radius (curvature) on the order of 30 millimeters) so as to produce the usual profile of the heel of a ski boot. The front end 104 of the linkage plate 100 is cut away in order to produce a rounded zone which extends approximately 25 degrees from each side of the median longitudinal axis 5 (with a radius (curvature) on the order of 25 millimeters) so as to produce the usual profile of the toe of a ski boot.

The central part 105 of the linkage plate 100 has a rectangular shape with a length of approximately 120 millimeters.

The rear part 106 of the linkage plate 100 has two holes 108, 109 forming the coaxial arcs of a circle, which are symmetrical relative to the median longitudinal axis 5. Likewise, the front part 110 of the linkage plate 100 has two holes 111, 112 forming the coaxial arcs of a circle, which are symmetrical relative to the median longitudinal axis 5. The central part 105 has two holes on each side of the median axis 5 (113, 114 and 115, 116, respectively), which are symmetrically paired relative to the median longitudinal axis 5.

The holes 113, 115 are symmetrical relative to the median transverse axis, and are constituted by the arcs of a circle having a center of curvature corresponding to the center 117 of the rear holes 108, 109. The angular aperture defined by the holes 113, 115 covers a sector between 1 degree and 16 degrees relative to the median longitudinal axis of the linkage plate 100. The holes 114, 116 are also symmetrical relative to the median transverse axis, and are constituted by the arcs of a circle having a center of curvature corresponding to the center 118 of the front holes 111, 112. The angular aperture defined by the holes 113, 115 covers a sector between 1 degree and 16 degrees relative to the median longitudinal axis of the linkage plate 100. The cross-sections of the holes 108, 109, 111, 112 (FIG. 3) reveal a lower part having a width corresponding to the head of a fastening bolt, and an upper part having a width corresponding to the body of the fastening bolt.

The linkage plate 100 supports a pair of bindings 120, 121 and 122, 123, respectively, for snowboarding boots of a known type. The bindings 120, 121, 122, 123 are solidly joined to the linkage plate 100 by screws passing through the holes 108, 109, 111, 112, 113, 114, 115, 116. Shims 130, 131, 132, 133 are interposed between the upper surface of the linkage plate 100 and the bindings 120, 121, 122, 123, respectively. The front shim 130 and the rear shim 133 interposed between the linkage plate 100 and the heel binding 120 of the rear boot 135 and the toe binding 123 of the forward boot 136, respectively, are thicker than the median shims 131, 132. The median shims 131, 132 are positioned on two opposing median holes 113, 116 or 114, 115. The thickness of the endmost shims 130, 133 is approximately 20 millimeters, and the thickness of the median shims 131, 132 is approximately 10 millimeters.

The semi-circular shape of the rear holes 108, 109 and the front holes 111, 112, and the elongated shape of the median holes 113, 114, 115, 116 allows the angular positioning of the bindings 120, 121, 122, 123 to be adjusted between an angle of 1 degree and an angle of 16 degrees relative to the longitudinal axis of the linkage plate 100.

The shapes of the shims 130, 131, 132, 133 are determined in order to cooperate with the profiles of the snowboarding boots 135, 136.

The linkage plate 100 has, at its rear end 106, a ski brake 140 having a conventional shape and function.

The linkage plate 100 is solidly joined with the board 1 by means of the safety bindings 101, 102, which ensure separation of the linkage plate 100 from the board 1 if the torque sustained by the user surpasses a predetermined adjustable value.

Figure 3:
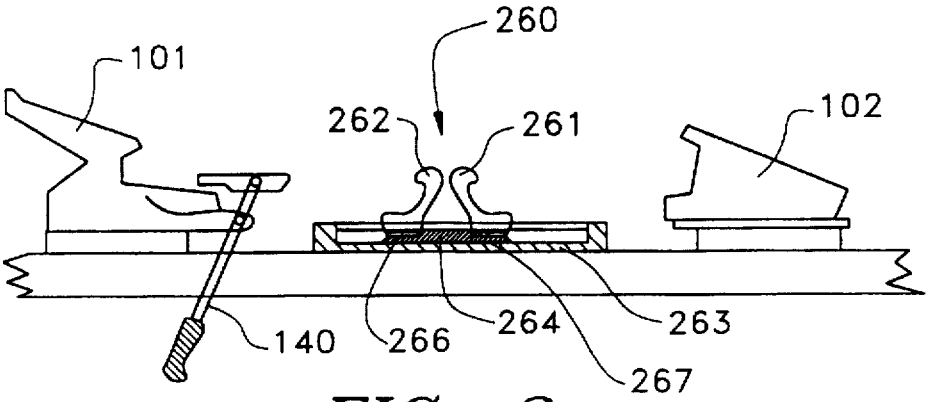
FIG. 3 is a partially sectioned, side elevational view of an alternative embodiment binding assembly.
Figure 4:
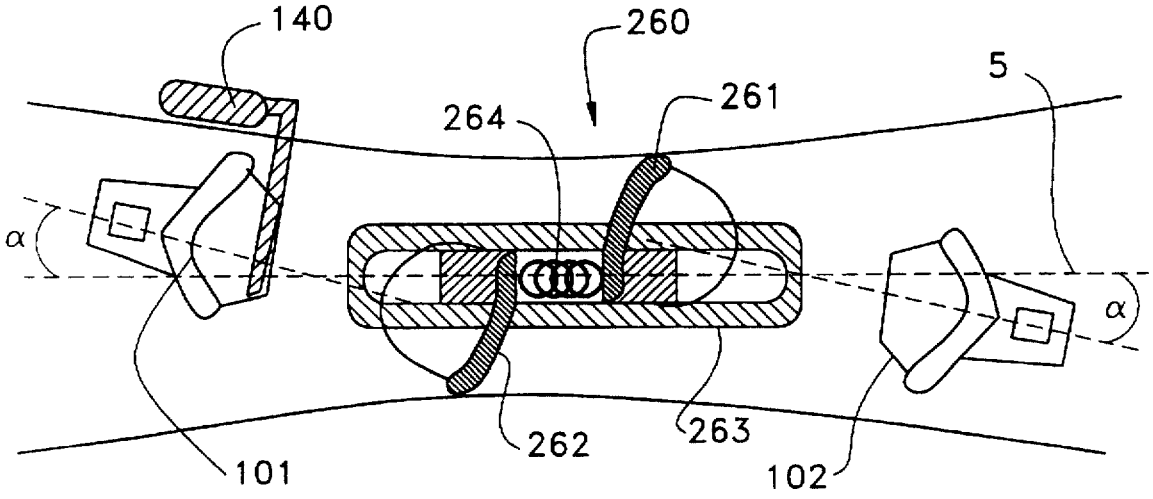
FIG. 4 is a partially sectioned, top plan view of the assembly of FIG. 3.

FIGS. 3 and 4 represent an alternative embodiment assembly for the bindings of a gliding apparatus according to the present invention. The bindings include a rear safety catch 101 and a front safety catch 102 of a known type. The catches 101, 102 are offset laterally relative to the median longitudinal axis 5 of the board 1, and form an angle α of approximately 7 degrees. The two bindings 101, 102 are separated by a distance substantially equivalent to the length of two ski boots, and are fastened to the board by screws in a known manner. The rear retaining catch 101 is equipped with a ski brake 140.

The bindings further include a median retaining assembly 260 constituted by two catches 261, 262 which are movable longitudinally relative to a guide rail 263. The front retaining catch 261 cooperates with the heel of the forwardmost boot, and is laterally offset in the example illustrated, toward the left of the board 1. The rear retaining catch 262 cooperates with the toe of the rearwardmost boot, and is laterally offset in the example illustrated, toward the right of the board 1. The guide rail 263 is disposed on the median longitudinal axis 5 of the board 1, and ensures that the retaining elements 261, 262 are guided in a direction that is substantially parallel to the median axis 5.

A spring 264 acts on two sliding blocks 266, 267 that are solidly joined with the retaining catches 261, 262, respectively, and that push the catches 261, 262 back against the ends of the boots. The spring 264 is calibrated so as to allow the release of the boots when the stress exerted on the user's legs surpasses a predetermined value.

Figure 5:
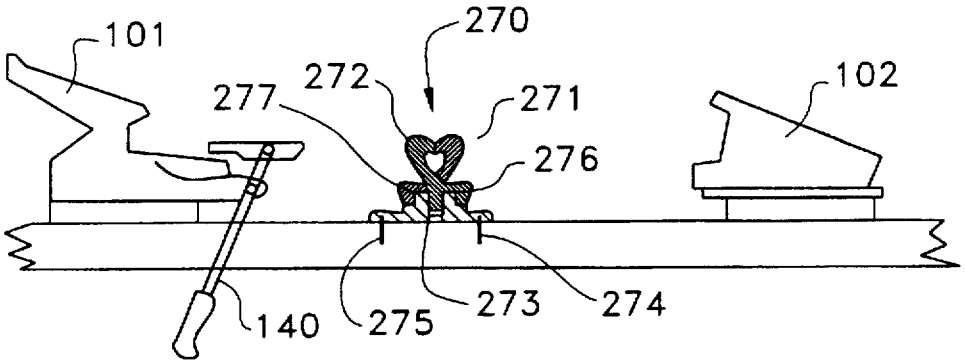
FIG. 5 is a partially sectioned, side elevational view of another alternative embodiment binding assembly.
Figure 6:
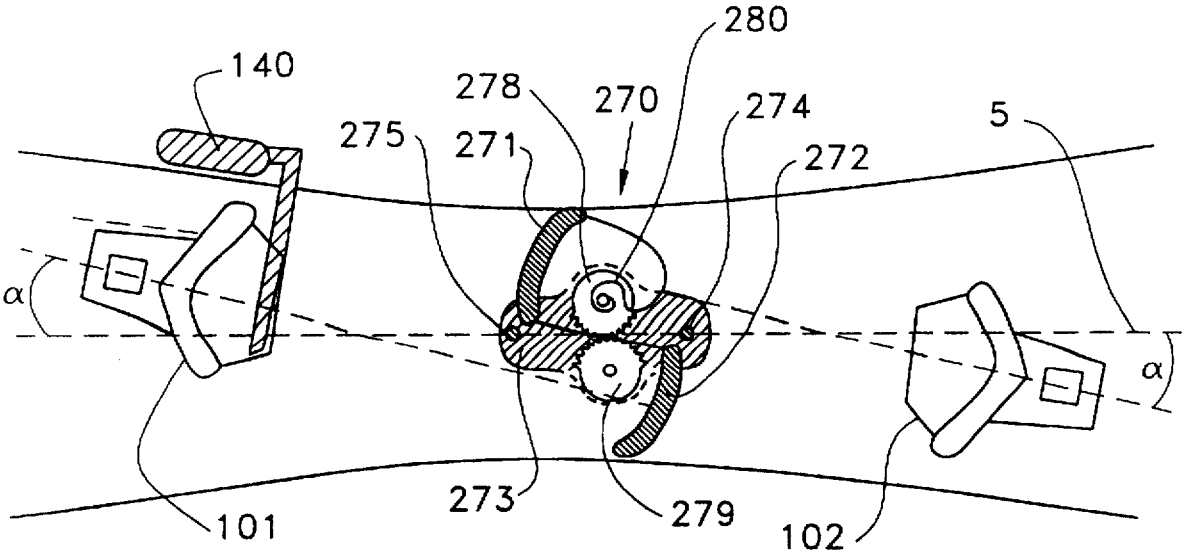
FIG. 6 is a partially sectioned, top plan view of the assembly of FIG. 5.

FIGS. 5 and 6 represent another alternative embodiment assembly for the bindings of a gliding apparatus according to the present invention. The bindings, as in the variant of FIGS. 3 and 4, include a rear safety catch 101 and a front safety catch 102 of a known type. The catches 101, 102 are offset laterally relative to the median longitudinal axis 5, forming an angle α of approximately 7 degrees. The two bindings 101, 102 are separated by a distance substantially equivalent to the length of two ski boots. The bindings 101, 102 are fastened to the board 1 by screws in a known manner. The rear safety catch 101 is equipped with a ski brake 140.

The binding assembly further includes two median catches 271, 272 supported by a plate 273 fastened to the board 1 by screws 274, 275. The median catches 271, 272 are articulated relative to the fixed plate 273 by two pivots 266, 267, respectively, which are substantially perpendicular to the surface of the board 1. The catches 271, 272 are mechanically coupled by toothed sectors 278, 279, respectively. Pivoting of one of the median catches causes the other catch to pivot along an angular course of the same amplitude. A return spring 280 assures that the median catches return to a neutral position in which, together with the median longitudinal axis 5, an angle is formed which is identical to the angle formed between the longitudinal axis of the safety catches 101, 102 and the longitudinal axis 5 (e.g., of approximately 7 degrees).

Figure 7:
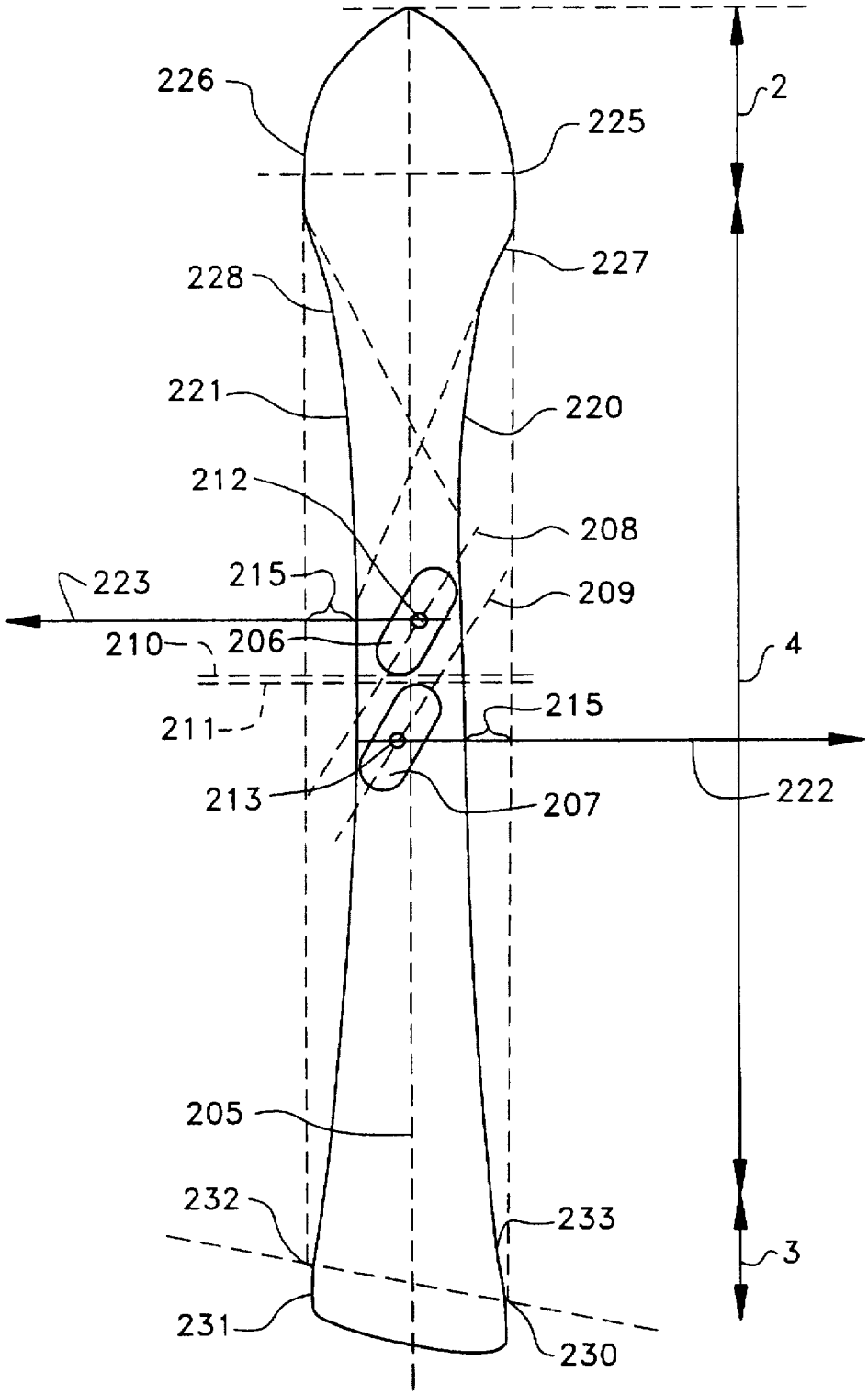
FIG. 7 is a top plan view of an alternative embodiment gliding assembly according to the present invention.

FIG. 7 shows an alternative embodiment gliding apparatus according to the present invention. In this embodiment, the total length of the board 201 will again vary as a function of the size and weight of the user (e.g., 178 centimeters). The width of the board 201, measured at the middle of the board, is preferably between 110 and 150 millimeters (140 millimeters in the present example).

The central portion 204 of the board 201 has a median longitudinal axis 205. The median zone of the central portion 204 of the board 201 allows two bindings 206, 207 for ski or snowboarding boots to be solidly joined to the board 201. The longitudinal axis 208 of the binding 206 and the longitudinal axis 209 of the binding 207 form an angle of approximately 7 degrees with the longitudinal axis 205 of the board 201.

The perpendicular 210 to the longitudinal axis 205 of the board 201 which runs through the rear of the forwardmost binding 206 is in front of, or at most coincides with, the perpendicular 211 to the longitudinal axis 205 of the board 201 which runs through the front of the rearwardmost binding 207. The distance between the rear end of the front binding 206 and the front end of the rear binding 207 is between 0 and 300 millimeters, and is preferably on the order of 50 millimeters. The centers 212, 213 of the bindings 206, 207, respectively, are offset laterally relative to the median longitudinal axis 205 of the board 201.

Laterally, the board 201 is defined by edges 220, 221 constituted by curved arcs extending along the major portion of the board's length (i.e., along the central portion 4). The board includes central hollows 215 (at its middle) of between 14 and 30 millimeters, and preferably on the order of 25 millimeters. The maximum width of the board 201 is on the order of 230 millimeters at the widest part of the tip 202 and on the order of 220 millimeters at the widest part of the heel 203.

The edges 220, 221 constitute a portion of a circle or an ellipse. In the case in which the board is symmetrical, the centers of the circles forming a circular arc or the midpoints of the two foci forming elliptical arcs, are placed on an axis which passes substantially through the midpoint of the centers of the bindings 206, 207. In the case in which the board is asymmetrical, the centers of the left and right arcs of a circle, or the midpoints of the two foci defining the left and right elliptical arcs, are respectively situated slightly behind and slightly in front of an axis running through the midpoint of the centers of the two bindings, on the axes 222, 223, respectively.

Between the beginning (the axis 225, 226) of the tip 202 and the ends of the curved side edges 220, 221, the board 201 has a segment with substantially rectilinear edges 227, 228 which facilitate edging and improve stability at the start of a turn. The two rectilinear segments 227, 228 are of identical length, and their angle β relative to the median longitudinal axis 205 of the board 201 is determined by the tangent at the resulting transition point. Straight segments 230, 231 may similarly be provided between the ends of the curved side edges 220, 221 and the beginning (the axis 232, 233) of the heel 203. Preferably, the length of the straight segments 230, 231 is substantially equal to the length of the straight segments 227, 228, and is on the order of 10 centimeters, with lengths between 2 centimeters and 25 centimeters being particularly advantageous.

The invention is described by way of the preceding non-limiting examples. It is to be understood that one skilled in the art will find numerous variants without departing from the scope of the present invention. In particular, the dimensions are indicated for a gliding apparatus for adults. It is understood that for a gliding apparatus for children, the dimensions would have to be reduced proportionately.

I claim:

1. An apparatus for gliding on snow with improved stability and better edge-setting in turns, comprising a single board having a median defining a longitudinal axis, a raised tip formed along forward portions of the board, a heel formed along rearward portions of the board, and a safety binding assembly for securely joining boots with the board so that the boots are prevented from moving relative to the board;

wherein the safety binding assembly includes a first binding having a median defining a longitudinal axis, for positioning a first boot on the board, the longitudinal axis of the first binding forming an angle with the longitudinal axis of the board of between 0 and 20 degrees, and a second binding having a median defining a longitudinal axis, for positioning a second boot on the board, the longitudinal axis of the second binding forming an angle with the longitudinal axis of the board of between 0 and 20 degrees;

wherein the second binding is longitudinally and rearwardly offset relative to the first binding, along the longitudinal axis of the board, so that the longitudinal distance from a rearwardmost point of the first binding to a forwardmost point of the second binding is no greater than 100 millimeters; and wherein the board includes laterally extending sides having center portions which are concave in shape between the tip and the heel of the board, rectilinear portions located where the center portions of the sides intersect with the tip and the heel of the board and further including a linkage plate receiving the first binding and the second binding and means for securely connecting the linkage plate to the board.

2. The apparatus of claim 1 wherein the angle with the longitudinal axis of the board for the first binding and for the second binding is between 4 and 16 degrees.

3. The apparatus of claim 1 wherein the longitudinal axis of the first binding is substantially parallel to the longitudinal axis of the second binding.

4. The apparatus of claim 1 wherein the rearwardmost point of the first binding is longitudinally to the rear of the forwardmost point of the second binding, relative to the longitudinal axis of the board.

5. The apparatus of claim 1 wherein the rearwardmost point of the first binding is longitudinally in front of the forwardmost point of the second binding, relative to the longitudinal axis of the board.

6. The apparatus of claim 1 wherein the longitudinal axis of the first binding and the longitudinal axis of the second binding each have a midpoint, and wherein the midpoint of the longitudinal axis of the first binding and the midpoint of the longitudinal axis of the second binding is positioned on the longitudinal axis of the board.

7. The apparatus of claim 6 wherein the longitudinal axis of the first binding is substantially parallel with the longitudinal axis of the second binding, forming an angle of approximately 7 degrees with the longitudinal axis of the board.

8. The apparatus of claim 7 wherein the first binding and the second binding have a toe portion and a heel portion, and wherein the toe portion of the first binding reaches one of the sides of the board and the heel portion of the second binding reaches another of the sides of the board.

9. The apparatus of claim 8 wherein the first binding and the second binding are symmetrically positioned on opposing sides of an axis forming an angle between 4 and 16 degrees with the longitudinal axis of the board.

10. The apparatus of claim 1 wherein the first binding and the second binding have a toe portion and a heel portion, and wherein the toe portion of the first binding and the heel portion of the second binding are positioned on the longitudinal axis of the board, and the heel portion of the first binding and the toe portion of the second binding are laterally offset, on opposing sides of the longitudinal axis of the board.

11. The apparatus of claim 10 wherein the first binding and the second binding are symmetrically positioned on opposing sides of an axis forming an angle between 4 and 16 degrees with the longitudinal axis of the board.

12. The apparatus of claim 11 wherein the first binding and the second binding are symmetrically positioned on opposing sides of an axis forming an angle between 4 and 16 degrees with the longitudinal axis of the board.

13. The apparatus of claim 1 wherein the board has a center positioned along the longitudinal axis of the board, and a width at the center of the board between 110 and 150 millimeters.

14. The apparatus of claim 13 wherein the width is about 140 millimeters.

15. The apparatus of claim 13 wherein the board has a length of about 178 centimeters.

16. The apparatus of claim 1 wherein the concave center portions of the sides of the board form arcs on each side of the board.

17. The apparatus of claim 16 wherein the arcs define circles having centers which are in alignment with an axis transverse to the longitudinal axis of the board.

18. The apparatus of claim 16 wherein the arcs define circles having centers which are positioned on opposing sides of an axis transverse to the longitudinal axis of the board.

19. The apparatus of claim 16 wherein the arcs define ellipses having foci which are aligned with each other, on opposing sides of the longitudinal axis of the board.

20. The apparatus of claim 19 wherein the foci of the ellipses are positioned on a pair of axes transverse to the longitudinal axis of the board.

21. The apparatus of claim 19 wherein the foci of the ellipses are offset relative to a pair of axes transverse to the longitudinal axis of the board.

22. The apparatus of claim 1 wherein the tip of the board has a widest portion, the heel of the board has a widest portion, and the center portions of the board have a narrowest portion, and wherein a distance extending along an axis perpendicular to the longitudinal axis of the board and through the narrowest portion of the board, from each side of the board to an axis connecting each side of the board at the widest portion of the tip and the widest portion of the heel, is between 1 and 3 centimeters.

23. The apparatus of claim 1 wherein the rectilinear portions include transitional portions of the edges connecting the center portions with the tip of the board.

24. The apparatus of claim 23 wherein the rectilinear portions further include straight segments extending from the center portions, along the heel of the board.

25. The apparatus of claim 24 wherein the straight segments have a length between 2 and 25 centimeters.

26. The apparatus of claim 25 wherein the length is about 10 centimeters.

27. The apparatus of claim 1 wherein the connecting means includes a pair of longitudinally spaced safety bindings positioned on the longitudinal axis of the board.

28. The apparatus of claim 27 wherein the linkage plate includes front and rear ends for cooperating with the safety bindings.

29. The apparatus of claim 1 wherein the linkage plate includes front and rear shims fastened to the linkage plate for angular adjustment relative to the linkage plate, and two median shims fastened to the linkage plate for lateral adjustment relative to the linkage plate.

30. The apparatus of claim 29 wherein the front and rear shims have a thickness between 5 and 30 millimeters and the median shims have a thickness between 0 and 20 millimeters, thereby placing the first binding and the second binding at angles relative to the linkage plate and to each other.

31. The apparatus of claim 11 wherein the board further includes a front catch, a rear catch, and a median assembly including two retaining elements which are mechanically coupled and movable between a neutral position for engaging a toe of a rear boot and a heel of a forward boot, and a safety position for releasing the boots responsive to an excess force exerted on the retaining elements.

32. The apparatus of claim 31 wherein the retaining elements of the median assembly form an angle with the longitudinal axis of the board which corresponds to the angle formed between the longitudinal axes of the first binding and the second binding and the longitudinal axis of the board.

33. The apparatus of claim 31 wherein the median assembly includes a longitudinal guide rail receiving two longitudinally movable retaining elements, wherein the retaining elements are separated by a calibrated spring.

34. The apparatus of claim 31 wherein the median assembly includes a fixed plate and two retaining elements which are securely joined to the fixed plate, and pivoted for rotation about two axes which are substantially perpendicular to surface portions of the fixed plate.

35. The apparatus of claim 34 wherein the two retaining elements are mechanically coupled by meshing toothed sectors, and a return spring for positioning the retaining elements along opposing angles corresponding to the angle formed between the longitudinal axes of the first binding and the second binding and the longitudinal axis of the board.

36. The apparatus of claim 31 wherein the front catch and the rear catch cooperate with the median assembly to form an angle of approximately 7 degrees with the longitudinal axis of the board, and wherein the median assembly is positioned on the longitudinal axis of the board.

* * * * *